US005655628A

United States Patent [19]

Lin

[11] Patent Number: 5,655,628

[45] Date of Patent: Aug. 12, 1997

[54] ELEVATOR SAFETY STRUCTURE

[76] Inventor: Wen-Tsung Lin, 3 Fl., No. 18, Lane 30, Hsing Hwa Rd., Nan Kang, Taipei, Taiwan

[21] Appl. No.: 496,004

[22] Filed: Jun. 28, 1995

[51] Int. Cl.[6] ..... B66B 7/00

[52] U.S. Cl. ..... 187/414; 182/84

[58] Field of Search ..... 187/414, 401, 187/314, 902; 182/101, 84, 88, 85

[56] References Cited

U.S. PATENT DOCUMENTS 1,977,706 10/1934 Watts ..... 187/414
5,220,979 6/1993 Matsuda ..... 187/401

FOREIGN PATENT DOCUMENTS 3293278 12/1991 Japan ..... 187/401

*Primary Examiner*—Kenneth Noland

*Attorney, Agent, or Firm*—Beveridge, DeGrandi, Weilacher & Young, L.L.P.

[57] ABSTRACT

Disclosed is a safety structure provided on an elevator car for the passengers to escape from the elevator car in case of an emergency that causes the elevator car to stop halfway between two floors. Besides, the safety structure can prevent maintenance technicians or objects from falling down through open entrance door to the base ground of the elevator tunnel when the elevator car is lifted halfway between two floors. The safety structure comprises a plurality of sidepieces secured to the bottom of the car and a series of rungs set between the sidepieces. In another embodiment, each of the plurality of sidepieces comprises a first segment and a second segment retractable into the first segment. In still another embodiment, each of the plurality of sidepieces comprises a chain of segments each linked to with a pivot such that the safety structure is collapsible. Besides, the bottom of each of the sidepieces of the aforementioned last two embodiments is provided with an elastic pad for cushioning against impact.

4 Claims, 5 Drawing Sheets

ELEVATOR SAFETY STRUCTURE

BACKGROUND OF THE INVENTION

The present invention relates to elevators, and more particularly, to a safety structure provided on the car of an elevator system for passengers to escape from the car in case of emergency.

Elevators are used widely in tall buildings for transporting people between floors. An elevator system includes a car pulled by hoist cables and guided by upright rails for the passengers to ride from floors to floors. Electric motors are usually used to drive the hoist cables to move the elevator car.

In the event of a fire or earthquake that causes interrupt of electrical power, it would be a terrifying experience for people riding an elevator car that stops because of the power interrupt halfway between two floors. Although the elevator car is conventionally provided with an emergency exit on the top, it is inconvenient, and somewhat dangerous, to use since the passengers have to climb up with effort through the ceiling of the elevator car to the outside and then step down the elevator car with extreme caution to the nearby entrance that is now opened by rescuers. In stepping down the elevator car, the passengers may risk their lives failing down from the high suspended elevator car to the base ground of the elevator tunnel.

Moreover, during maintenance work for the elevator system, the elevator car may be shifted to stop halfway between two floors. With the entrance door left open, it is a danger for the maintenance technicians or objects should they fall through the open entrance door to the base ground of the elevator tunnel.

In view of the foregoing two problems, there exists therefore a need for a safety structure that allows passengers riding an elevator car which stops suddenly due to an emergency halfway between two floors to escape from the elevator car conveniently and safely, and another safety structure that can prevent maintenance technicians or objects from falling through the open entrance door when the elevator car is lifted halfway between two floors for maintenance. To save cost, it would be best if the two needed safety structures can be one that serves two purposes.

SUMMARY OF THE INVENTION

It is therefore a primary objective of the present invention to provide an elevator safety structure that can be used as a safety ladder which allows passengers to escape from the elevator car in case of an emergency that causes the elevator car to stop halfway between two floors.

It is another objective of the present invention to provide an elevator safety structure that can be used as a safety fence to prevent maintenance technicians or objects from falling down through an open entrance door to the base ground of the elevator tunnel when the elevator car is lifted halfway between two floors to make convenience for the maintenance.

It is still another objective of the present invention to provide an elevator safety structure that allows maintenance technicians to conveniently use as a stepladder for maintenance work within the elevator tunnel.

In accordance with the foregoing and other objectives of the present invention, there is provided an elevator safety structure for passengers to escape from the elevator car in case of an emergency. The safety structure comprises a plurality of sidepieces secured to the bottom of the car and a series of rungs set between the sidepieces. In another embodiment, each of the plurality of sidepieces comprises a first segment and a second segment retractable into the first segment. In still another embodiment, each of the plurality of sidepieces comprises a chain of segments each linked to with a pivot such that the safety structure is collapsible. Besides, the bottom of each of the sidepieces of the aforementioned last two embodiments is provided with an elastic pad for cushioning against impact.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

First Preferred Embodiment

Figure 1A:
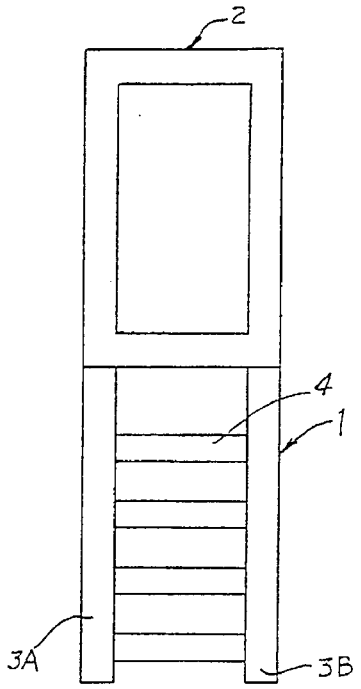
FIGS. 1A–1B show respectively the front view and side view of an elevator safety structure according to the first preferred embodiment of the present invention.
Figure 1B:
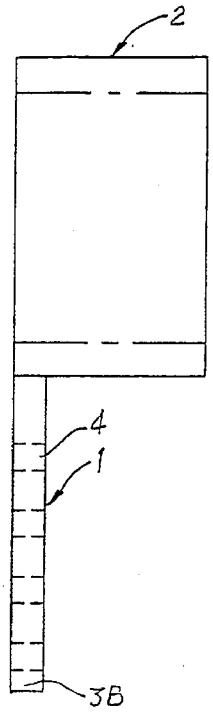

FIGS. 1A–1B show respectively the front view and side view of an elevator safety structure 1 according to the first preferred embodiment of the present invention, which is provided on the car 2 of an elevator system at the bottom of the car door. The elevator safety structure 1 is composed of two sidepieces 3A and 3B and a series of rungs 4 set between the two sidepieces 3A and 3B. The length of each rung 4, or the distance between the two sidepieces 3A and 3B, is preferably not to exceed the width of the elevator car 2; and the height of the two sidepieces 3A and 3B is set according to the base depth of the elevator tunnel (the base depth is the distance from the base of the elevator tunnel to the platform of the elevator car 2 when the elevator car 2 stops at the bottom-most level). Generally, the height of two sidepieces 3A and 3B can be set equal to the height of the elevator car door. If the base depth is less than the height of the elevator car door, the two sidepieces 3A and 3B can be suitably shortened, or adopt a retractable-type of safety structure according to the second preferred embodiment shown in FIGS. 2A–2B or a collapsible-type of safety structure according to the third preferred embodiment shown in FIGS. 3A and 38, both of which will be described below.

Second Preferred Embodiment

Figure 2A:
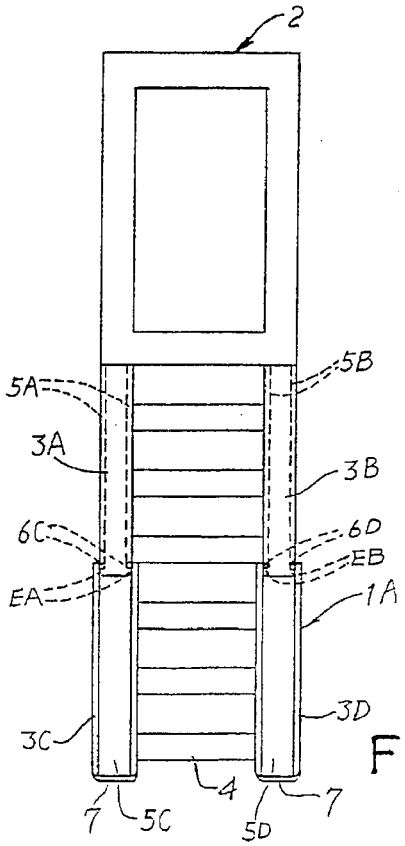
FIG. 2A shows the front view of an elevator safety structure according to the second preferred embodiment of the present invention, which is made retractable.
Figure 2B:
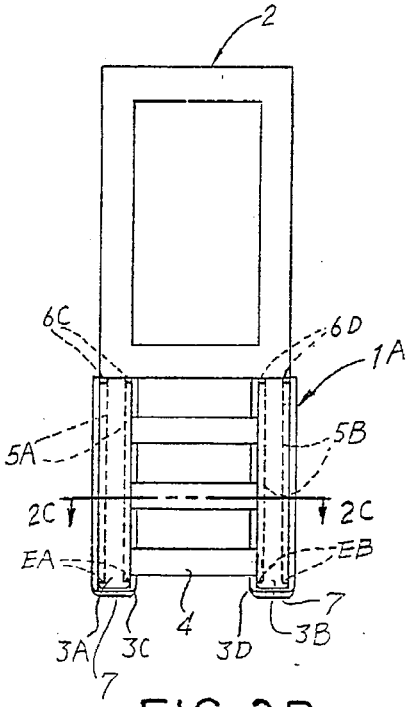
FIG. 2B shows the elevator safety structure of FIG. 2A when it is retracted.
Figure 2C:
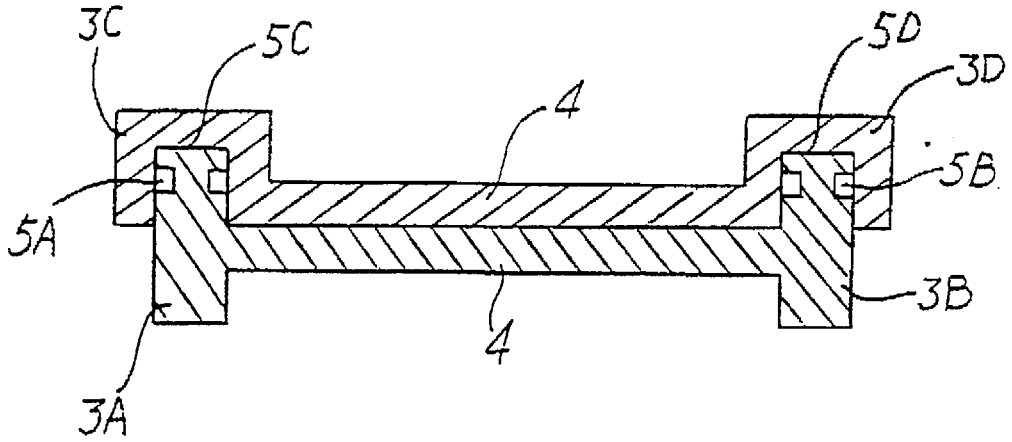
FIG. 2C shows a cross sectional view of the elevator safety structure of FIG. 2B cutting through the line A—A.

FIG. 2A shows an elevator safety structure 1A according to the second preferred embodiment of the present invention, which is made retractable by providing two-segmented sidepieces, one being 3A and 3C and the other being 3B and 3D, in which 3C and 3D are retractable. A series of rungs 4 are provided between the upper sidepieces 3A and 3B and also between the retractable sidepieces 3C and 3D. The retractable sidepieces 3C and 3D are respectively provided with guide rails 5C and 5D. Protrusions 6C, 6D are provided on the top of the guide rails 5C, 5D and inset in guide grooves 5A, 5B on both sides of the top-segment sidepieces 3A, 3B. This provision allows the retractable sidepieces 3C and 3D to be slidably pushed upwards to be combined with the upper sidepieces 3A and 3B, thus be retracted as illustrated in FIG. 2B. With stoppers EA, EB provided on the bottom of the guide grooves 5A, 5B, the bottom-segment sidepieces 3C, 3D can be prevented from sliding down when the protrusions 6C, 6D thereon meet the stoppers EA, EB. FIG. 2C shows a cross sectional view of the safety structure in retracted condition when the bottom-segment sidepieces 3C, 3D are retracted into the top-segment sidepieces 3A, 3B.

The upper sidepieces 3A and 3B are about the same length as the retractable sidepieces 3C and 3D. The length, however, should be less than the base depth of the elevator tunnel. When the elevator car 2 stops at the bottom-most level, if the sidepieces 3C and 3D touch the base, they can be forced to retract into the sidepieces 3A and 3B. With elastic pads 7 provided at the bottom, the impact of the sidepieces 3C and 3D against the base can be cushioned to provide protection for the sidepieces 3C and 3D and also reduce impact noise. Besides, the length of the sidepieces 3A and 3B being less than the base depth can prevent the sidepieces 3A and 3B from crashing into the base. When the elevator car 2 is lifted from the base level, the retracted sidepieces 3C and 3D can be pulled by gravity back to extended position.

Third Preferred Embodiment

Figure 3C:
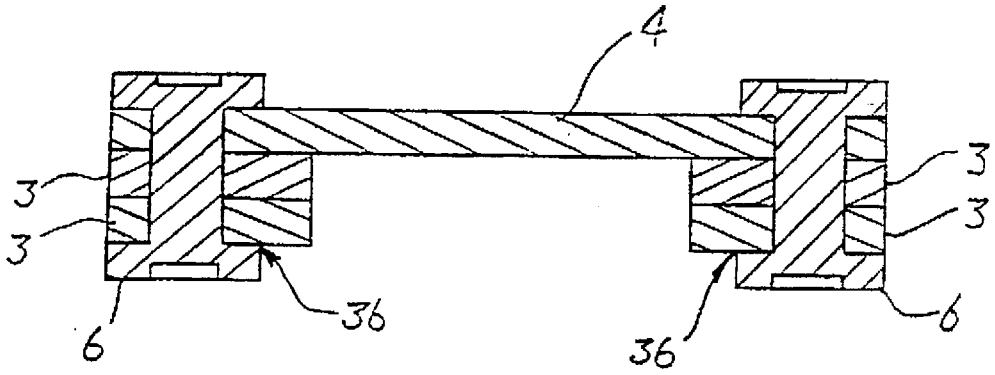
FIG. 3C is a cross sectional view of the elevator safety structure of FIG. 3B cutting through the line B—B.
Figure 3A:
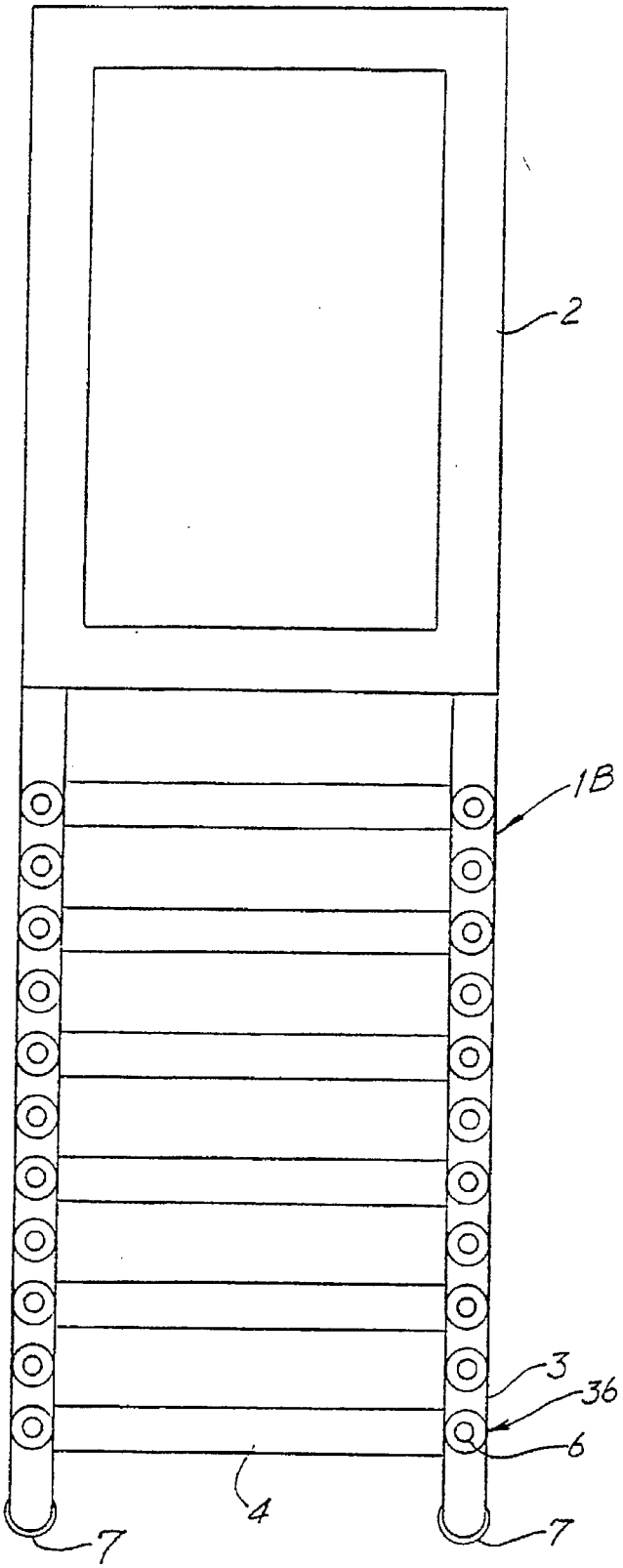
FIG. 3A is a front view of an elevator safety structure according to the third preferred embodiment of the present invention, which is made collapsible but shown in extended condition.
Figure 3B:
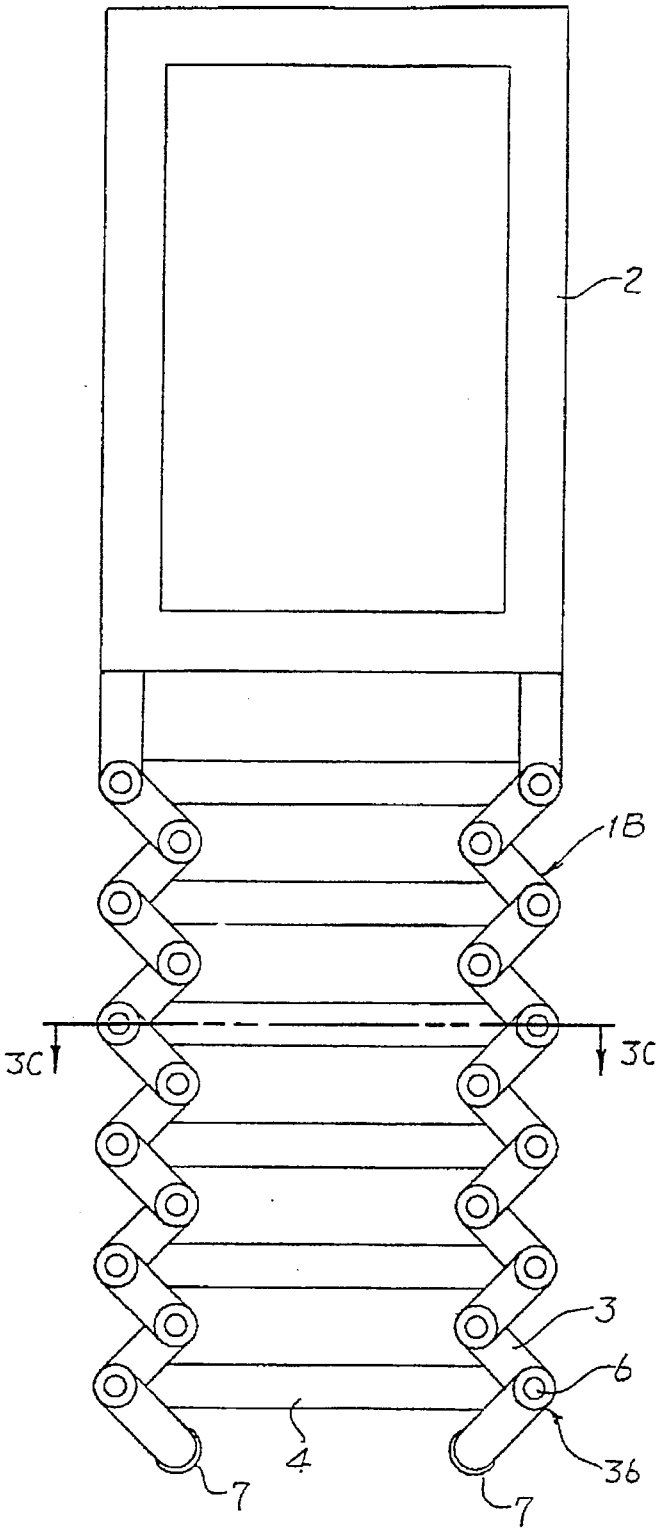
FIG. 3B is a front view of the elevator safety structure of FIG. 3A, showing the elevator safety structure in collapsed condition.

FIGS. 3A–3C show the third preferred embodiment of the safety structure 1B according to present invention, which is made collapsible by modifying the sidepieces of the structure into a chain of sections 3 each linked to the, other at the joint 36 with a pivot 6. A series of rungs 4 are provided along the sidepieces, each being linked to one pivot 6 at an interval of two sections each.

Referring to FIG. 3B, the minimum height of the safety structure 1B, i.e., the length of the safety structure 1B when it is completely collapsed, should be less than the base depth. When the elevator car 2 stops at the bottom-most level, if the sidepieces touch the base, the safety structure 1B can be forced to collapse. The minimum height of the safety structure 1B being less than the base depth allows the safety structure 1B not to crash into the base when the elevator car 2 stops at the bottom-most most level. With elastic pads 7 provided at the bottom, the impact of the sidepieces against the base can be cushioned to provide protection for the sidepieces and also reduce impact noise. When the elevator car 2 is lifted from the bottom-most level, the collapsed sidepieces can be pulled by gravity so as to restore the safety structure back to extended condition as that shown in FIG. 3A. The combination of adjoining sidepiece segments 3 and rungs 4 at the pivots 6 can be seen with reference to FIG. 3C.

Figure 4:
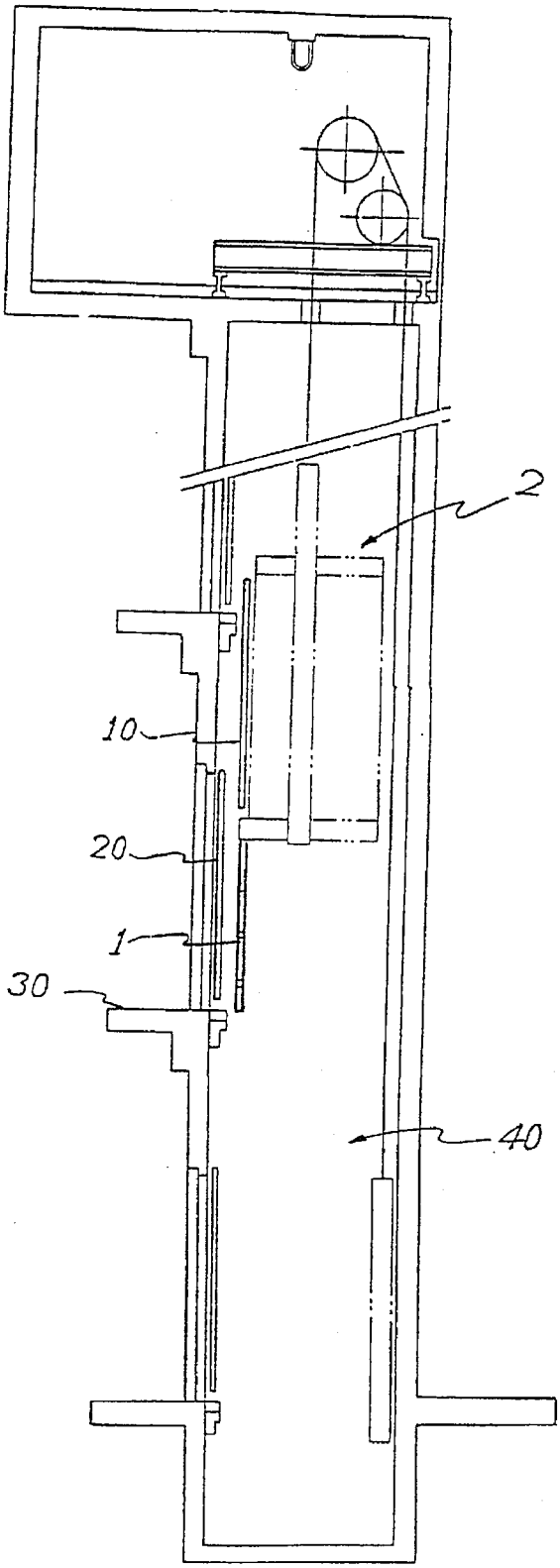
FIG. 4 is a schematic diagram showing an elevator system employing the safety structure according to the present invention.

Referring to FIG. 4, in case of an emergency that causes the elevator car 2 to stop halfway between two floors, passengers in the elevator car 2 can open the elevator car door 10 and, after the underneath entrance door 20 is also opened, step down the safety structure 1 which is used as a safety ladder to the underneath floor 30. Beside this benefit, the safety structure 1 also acts a safety fence that prevents maintenance technicians or objects from falling through the entrance door 20 down to the base of the elevator tunnel when the entrance door 20 is open during the maintenance.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A safety structure for use in an elevator system using a car to transport passengers which allows passengers to escape from said car during an emergency, said safety structure comprising:

a plurality of sidepieces secured to a bottom of said car; and a series of rungs engaged between said sidepieces, wherein each of said sidepieces include:

a first segment having a guide groove defined therein, said guide groove having a stopper provided at a bottom end thereof, and a second segment having a guide rail, said guide rail having two protrusions provided on both sides of a top end thereof, said guide rail slidably engaging said guide groove of said first segment such that said second segment is retractable with respect to said first segments said second segment being prevented from detaching from said first segment by means of said stopper and said protrusion when said safety structure is extended.

2. A safety structure as claimed in claim 1, wherein the bottom of each of the sidepieces is provided with an elastic pad for cushioning against impact.

3. A safety structure for use in an elevator system using a car to transport passengers which allows passengers to escape from said car during an emergency, said safety structure comprising:

a plurality of sidepieces secured to a bottom, of said car; and a series of rungs engaged between said sidepieces, wherein, each of said plurality of sidepieces include a chain of segments, each segment being pivotally linked with a sucessive link such that said safety structure is collapsible.

4. A safety structure as claimed in claim 3, wherein the bottom of each of the sidepieces is provided with an elastic pad for cushioning against impact.

* * * * *